175-61 SR
10/22/85 OR 4,548,282

United States Patent [19]
Hurtz et al.

[11] Patent Number: 4,548,282
[45] Date of Patent: Oct. 22, 1985

[54] METHOD FOR SINKING BOREHOLES

[75] Inventors: Georg Hurtz, Erkelenz; Heinz P. Vogts, Hückelhoven-Rurich, both of Fed. Rep. of Germany

[73] Assignee: Wirth Maschinen-Und Bohrgerate-Fabrik GmbH, Erkelenz, Fed. Rep. of Germany

[21] Appl. No.: 495,501

[22] Filed: May 17, 1983

[30] Foreign Application Priority Data

May 22, 1982 [DE] Fed. Rep. of Germany ..... 3219362

[51] Int. Cl.[4] ..... E21B 7/10
[52] U.S. Cl. ..... 175/61; 175/267
[58] Field of Search ..... 175/57, 61, 73, 97, 175/263, 267, 269; 299/31, 80

[56] References Cited

U.S. PATENT DOCUMENTS

| | | | |
|---|---|---|---|
| 2,711,888 | 6/1955 | Robbins et al. | 299/80 |
| 2,998,964 | 9/1961 | Morlan | 299/80 |
| 3,386,520 | 6/1968 | Lawrence et al. | 299/31 |
| 3,554,603 | 1/1971 | Emden et al. | 299/31 |
| 4,403,664 | 9/1983 | Sullinger | 175/24 |

FOREIGN PATENT DOCUMENTS

| | | |
|---|---|---|
| 2824441 | 12/1978 | Fed. Rep. of Germany . |
| 924237 | 4/1963 | United Kingdom . |
| 187693 | 12/1966 | U.S.S.R. . |
| 748007 | 7/1980 | U.S.S.R. . |

*Primary Examiner*—Stephen J. Novosad
*Assistant Examiner*—Michael Goodwin
*Attorney, Agent, or Firm*—Holman & Stern

[57] ABSTRACT

A method of and apparatus for sinking essentially vertical bores, in particular large-hole bores, shafts or the like, the bore direction being pre-determined for a bore head or the like, rotatable by means of a set of bore rods, using a device which may be fixed with respect to the borehole wall after a bore section has been bored, wherein the device is released, the bore head is moved in a stationary state into a position suspended on the bore rods and then the direction is determined for the next bore section, the diameter of the bore head for determining the direction of the next bore section being changed from a relatively larger to a relatively smaller size.

4 Claims, 10 Drawing Figures

METHOD FOR SINKING BOREHOLES

BACKGROUND OF THE INVENTION

Field of the Invention

The invention relates to a method of sinking essentially vertical bores, in particular large-hole bores, shafts or the like, the bore direction being pre-determined for a bore head or the like—rotatable by means of a set of bore rods—using a device which may be fixed with respect to the borehole wall after a bore section has been bored.

The object of the invention is to provide an advantageous method of sinking essentially vertically orientated bores of the type described above, by which relatively large boreholes, in particular above approximately 1.5 to 2 m, may be sunk with a good degree of verticality while operating with rotating bore rods.

BRIEF SUMMARY OF THE INVENTION

In order to attain this object, in the case of a method of the type described above, the invention provides that the device which may be fixed on the borehole wall is released, the bore head is moved in the stationary state into a position suspended on the bore rods and then the direction is determined for the next bore section, the diameter of the bore head for determining the direction of the next bore section being changed from a relatively larger to a relatively smaller size.

By virtue of a method of this type it is possible to produce even large boreholes with a favorable degree of verticality in a particularly simple manner, without special steps in terms of measurements and special adjustment procedures being necesary for this purpose. It is sufficient in each case merely to fix the direction in a simple manner while the bore head is suspended. If a deviation from the vertical has occurred in the preceding bore section, a correction is made in the next bore section, the bore head where necessary working a crescent-shaped area of the rock. The verticality is then regained again very soon, either in the immediately following bore section or, in the case of a very marked deviation, in the following bore section or sections.

In addition, there are possibilities various of embodiments for the method. Thus it is provided that in the case of two successive and possibly also further bore sections each of them is bored with the relatively larger diameter of the bore head. The diameter of the bore head, reduced in order to determine the direction for the second bore section, is then increased again before or at the beginning of this second bore section.

In another embodiment it is provided that in the case of two successive and possibly also further bore sections each of them is bored with the relatively smaller diameter of the bore head and the diameter of the bore head is increased only between the two bore sections, and at least one length corresponding approximately to the height of the bore head is bored with this diameter, the diameter of the bore head is reduced again, then the direction is determined for further boring with the bore head in the suspended state and after this the next bore section is bored.

The limited length section with the greater diameter is advantageously bored inside the bore section preceding the new determination of direction, i.e. inside the corresponding stroke of the movement of the bore head relative to the clamping device. Boring with the increased diameter may be performed in a downward direction. It may also be advantageous, however, after finishing a bore section in the downward direction with the reduced diameter to bore a certain length with the increased diameter upwards again in an enlarging manner, i.e. likewise inside a stroke which is possible without releasing the device which may be secured to the borehole wall. The release itself takes place only when the bore head is moved into the bore area with the increased diameter and is to occupy its position suspended on the bore rods.

Finally, it is also possible for a length to be bored with a greater diameter after finishing a bore section in a separate intermediate step, for which the device which may be secured to the borehole wall is moved into a position which permits the necessary stroke.

When mention is made in this description or in the claims of an increased or reduced diameter of the bore head or of a relatively larger and a relatively smaller diameter of the bore head respectively, this need not mean merely a maximum and a minimum operating diameter of the bore head in the sense of two possible states, although this will be so in the majority of cases, but rather diameters within a range between a maximum and a minimum diameter may be considered, which may then be distinguished from one another as being relatively larger or relatively smaller.

The concept of the bore section should embrace not only one using the complete stroke of the bore head relative to the device which may be secured to the borehole wall, but also a section which may constitute only part of this stroke.

An advantageous apparatus for sinking essentially vertical bores, which is particularly suitable for performing the method described includes a bore head which comprises at least one tool which may be moved from an outer operating position into a position lying further inside and vice versa and by the setting of which the operating diameter of the bore head may be reduced and enlarged.

The range of such a movement of one or more tools or groups of tools may be set for example while taking account of a specific bore stroke, and also in the sense that the movable tools can occupy only two positions, namely an outer and an inner one. The embodiment may be such, however, that the tools may be set in intermediate positions between the end positions.

In particular, the bore head may be constructed in various ways, above all in the manner of an eccentric bit, reamer, or the like. The tool which may be moved from the outside to the inside and vice versa may be mounted pivotably and/or displaceably on a bore head or base. Accordingly, a plurality of tools may also be moved jointly in a group in the manner described.

Although drive devices of various types may be considered for effecting the movement or movements of tools of this type, the invention provides in particular for hydraulic actuating devices, namely piston-cylinder units.

In the case of an embodiment in which the clamping elements of the clamping device are displaceable by means of hydraulic piston-cylinder units, the embodiment is advantageously such that the piston-cylinder units for the clamping elements and the hydraulic actuating devices for the movable tools on the bore head may on the one hand be acted upon separately with pressure medium in the sense of an outwardly directed movement of the clamping elements and the tools and may on the other hand be acted upon jointly with pressure medium in the sense of an inwardly directed movement of the clamping elements and the tools. Apart from an hydraulic oil, water may also be used as pressure medium.

In the case of an embodiment of the apparatus in the manner described above, a pressure medium supply line for the actuating devices of the movable tools may, in particular, be led through the bore rods or formed thereby.

Unlockable non-return valves or other suitable hydraulic blocks or the like are advantageously associated with the piston-cylinder units for the clamping elements, thus resulting in a simple system.

A further advantageous apparatus for carrying out the method includes, actuating members, by which control members for influencing the outward movement of the clamping elements may be actuated directly or indirectly, provided on the clamping elements or on components movable therewith, e.g. piston rods, holders or the like. In this way the procedure of setting the clamping elements to the borehole wall may be arranged particularly advantageously, in particular with respect to the uniformity of the last part of the setting or pressing against the borehole wall.

The actuating members may be parts of various types, for example limit switches or the like. According to a special feature, movable sensing elements, which project outwards in the rest position beyond the clamping elements so that they come into contact with the borehole wall before the latter and may then be retracted by a certain amount, are provided on the clamping elements or on components joined thereto for the purpose of simultaneous movement. The drive system for moving the clamping elements, namely an hydraulic system, is advantageously constructed with corresponding control members in such a way that all the clamping elements first reach a position in which the sensing elements have made contact with the borehole wall, and only then do all the clamping elements cover a final relatively small path through which the clamping elements are simultaneously pressed against the borehole wall. The preceding paths may be different depending upon the local situation. In the case of an hydraulic system the desired course may be attained with the aid of valves, different stages of pressure being successively actuated in particular.

BRIEF DESCRIPTION OF THE DRAWINGS

The invention will be further described, by way of example only, with reference to the accompanying drawings, wherein.

DETAILED DESCRIPTION

Figure 5:
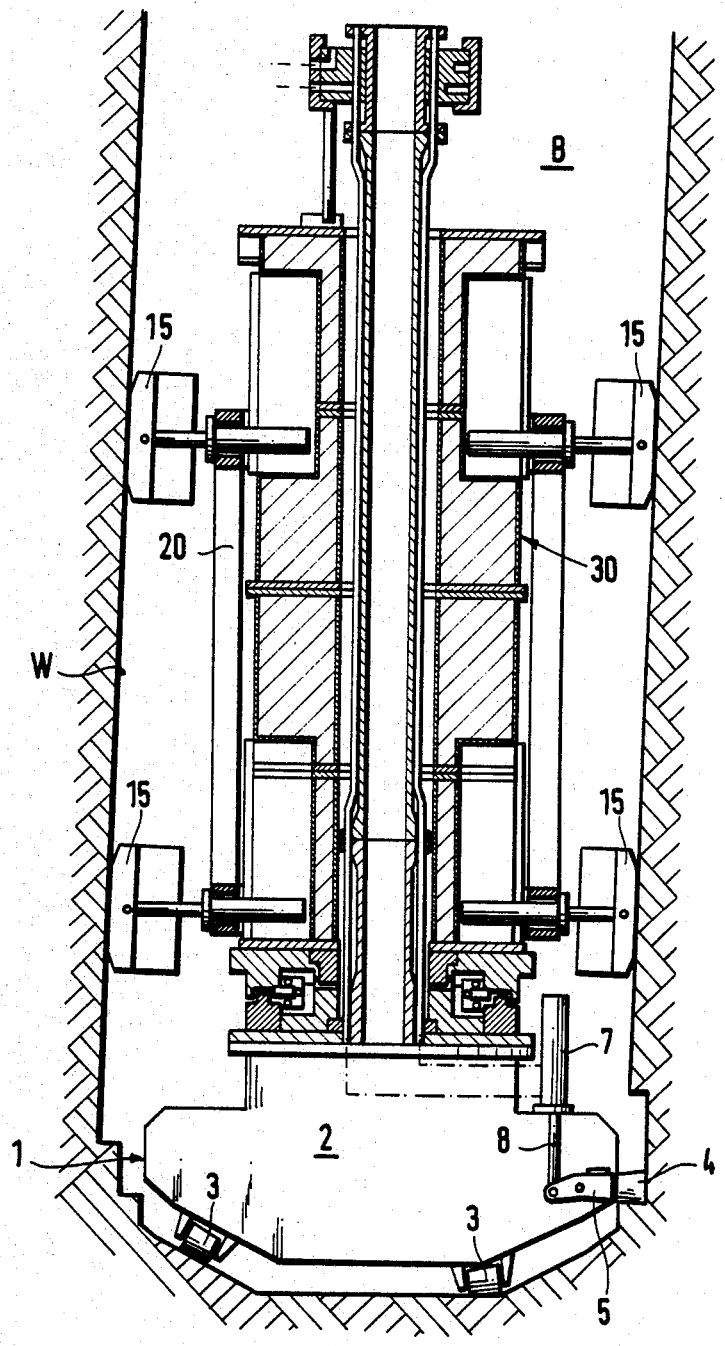
FIG. 5 is a view similar to FIG. 1 showing the apparatus at the beginning of a further bore section.
Figure 6:
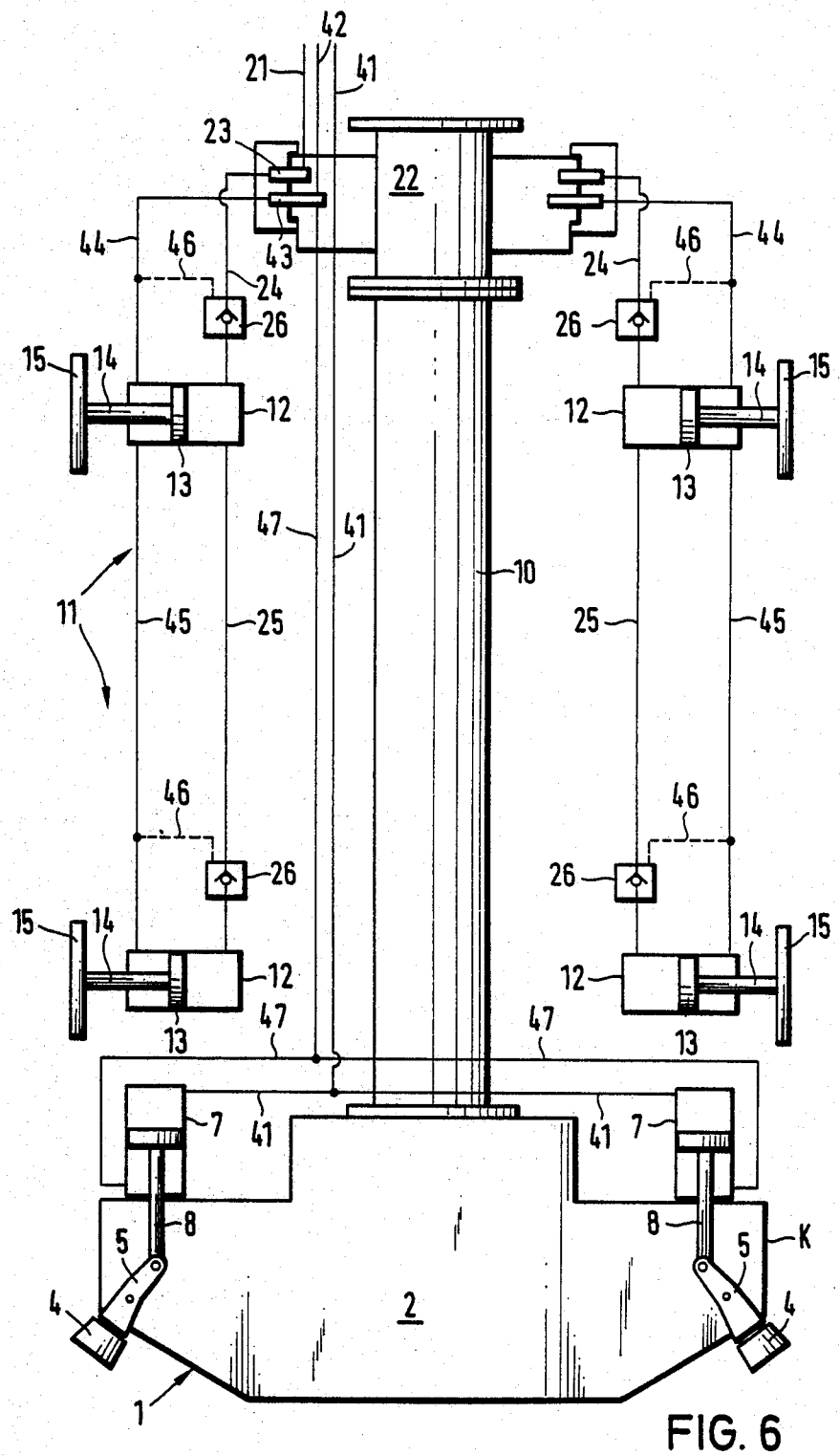
FIG. 6 is a view of an embodiment of a pressure medium system for an apparatus of the type illustrated in FIGS. 1 to 5.

In the drawing, the numeral 1 designates a boring tool in the form of a bore head, the base 2 of which is provided with roller bits, cutting rollers 3 shown diagrammatically only at individual places. In addition, the bore head 1 has at least one cutting roller 4 which operates as a sizing tool in the case of this embodiment and whose carrier formed as a two-armed lever 5 is pivotably mounted on a pin 6 in such a way that it may be moved by means of an actuating device 7 from an operating position projecting outwards in the radial direction beyond the profile K of the base 2 of the bore head 1 (FIGS. 1 and 5) into a retracted inner position (FIGS. 2 and 6) and vice versa. In the case of the bore head 1 according to FIGS. 1 to 5, in its retracted position the cutting roller 4 is in fact inside the outer profile K of the bore head 1. In the case of another embodiment, however, such cutting rollers 4 may project beyond the profile K of the base 2 of the bore head 1 even in their inner position, without departing from the basic principle of the invention. The desired result may be attained with different forms of bore heads of this type and movable tools. FIG. 6 shows two tools 4 which are displaceable in the same direction. In the case of a bore head with a maximum operating diameter of 4.0 m the diameter reduction advantageously amounts to at least 0.2 m.

The actuating device 7 for pivoting the respective cutting roller 4 is in particular an hydraulic piston-cylinder unit (cf. FIG. 6) which is pivotably connected to the carrier 5 of the cutting roller 4 in a suitable manner by way of a connecting rod or piston rod 8. In the operating position the carrier 5 of the cutting roller 4 bears against a stop 9 on the base 2 of the bore head 1, so that all strains are securely absorbed.

Figure 1:
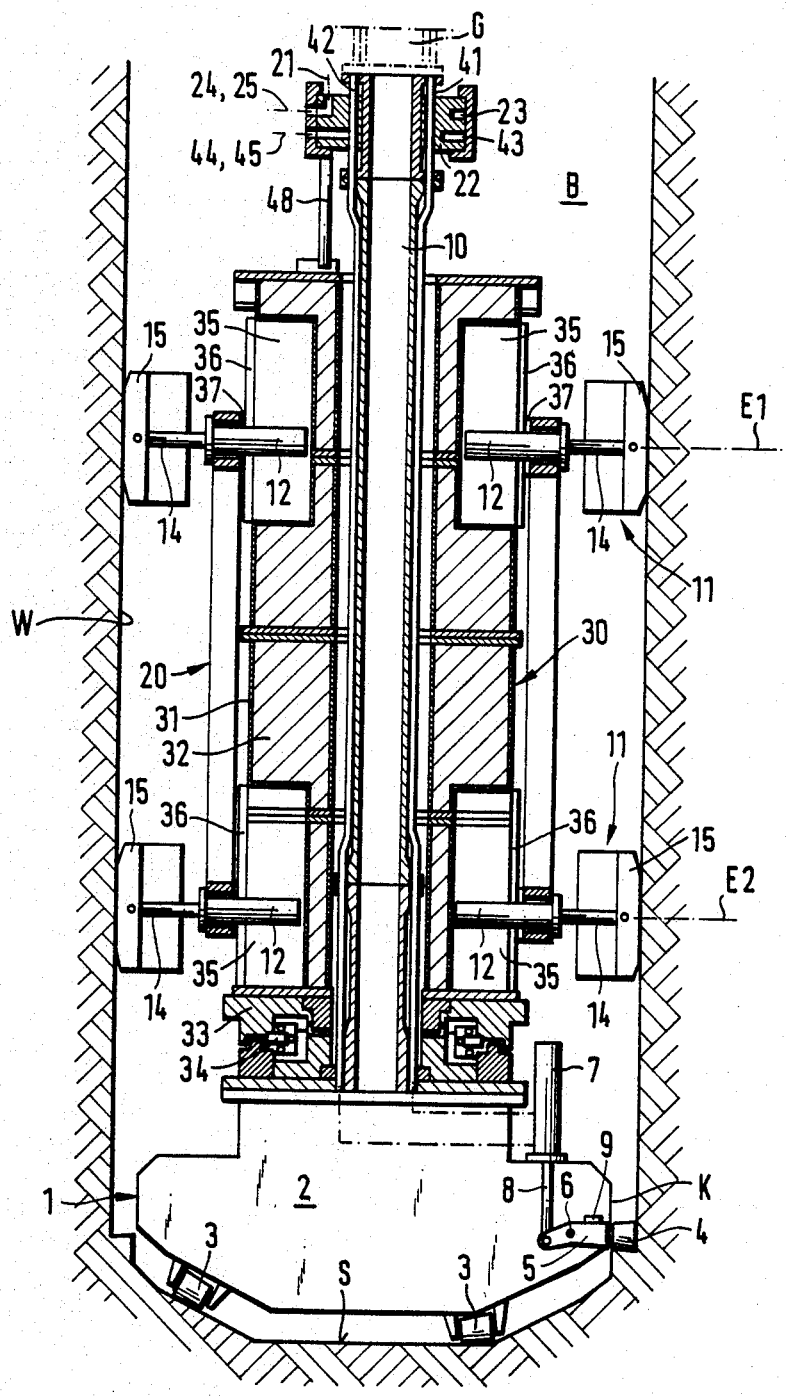
FIG. 1 shows an embodiment of the apparatus suitable for carrying out the method of the invention, partially in vertical longitudinal cross-section and partially diagrammatic in an operating position.

The bore head 1 is joined to a drive shaft 10 which is connected to bore rods G which may be rotatably driven in known manner by a conventional device disposed on the surface and which are indicated merely by dash-dot lines in FIG. 1. They may be screwed rods or even flanged rods. It is particularly advantageous for both the bore rods G and the drive shaft 10 to be hollow, so that a boring operation may be employed with a flushing action, in particular according to the principle of the airlift process.

A clamping device designated 11 as a whole is disposed in the area of the apparatus adjacent to the bore head at the rear. This clamping device has a frame-like support member 20 as a guide portion, to which are secured in each case four radially orientated pressure medium cylinders 12 distributed regularly over the periphery in two planes E1 and E2 vertically spaced from one another. At the ends of their piston rods 14 the pistons 13 which are extendable and retractable in the pressure medium cylinders 12 (FIG. 6) have clamping elements 15 in the form of plates, shields or the like, which are held angularly movably on the piston rods and which may be pressed against the wall W of the borehole B produced by the bore head 1 and then hold the support member 20 securely in the clamped position.

In the embodiment illustrated, the support member 20 forming the guide portion of the clamping device 11 surrounds a loading weight comprising one or more parts and designated 30 as a whole. In the example shown, this consists of a casing 31 which is filled with lead, concrete or other material 32 suitable for weighting. It rests on a base member 33 on which is disposed the bearing 34—only shown substantially diagrammatically—of the bore head 1 in the axial and radial direction. Suitable recesses 35, which offer the necessary space for the cylinders during the relative displacement between the bore head 1 and the clamping device 11, are provided in the loading weight 30.

Figure 3:
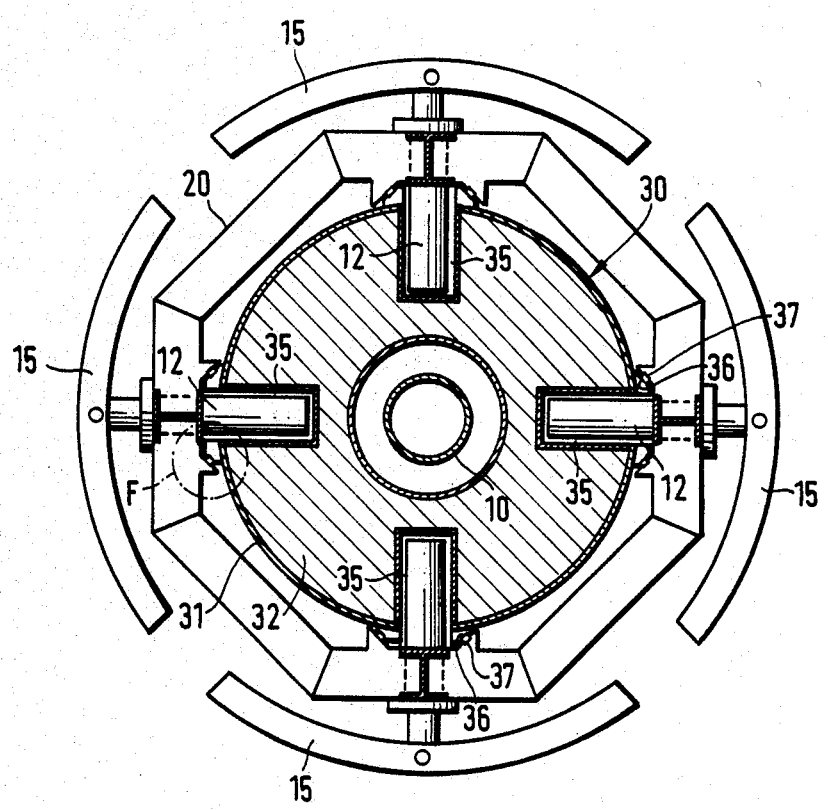
FIG. 3 is a cross-sectional view taken along the line III—III in FIG. 2.
Figure 4:
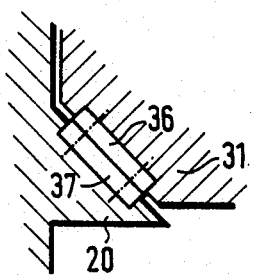
FIG. 4 shows the position F in FIG. 3 on an enlarged scale and in cross-section.

The loading weight 30 is formed and mounted such that it cooperates with the guide portion 20 of the clamping device 11 in such a way that in the clamped operating state a trouble-free directional guidance is provided for the bore head 1. Guide strips 36 of suitable material, which slide on corresponding guide elements 37 on the support member 20, as shown in particular in FIGS. 3 and 4, are arranged on the casing 31 or a part joined thereto.

All the cylinders may be simultaneously charged with pressure medium, such as water or an hydraulic liquid, so that the clamping members may all be extended together, namely with different paths until the clamping members bear against the wall of the borehole.

In the embodiment of the hydraulic system, as shown diagrammatically in FIG. 6, a line 21, which is led for example along the outside of the bore rods and continues by way of a ring transformer or rotary distributor 22 with an annular duct 23 into lines 24, 25 on the non-rotating part (clamping device 11 and loading weight 30) of the apparatus (shown only in FIG. 1), is provided in order to supply pressure medium to the filling spaces of the cylinders 12 and to remove medium therefrom respectively. An unlockable non-return valve 26 is associated with these lines upstream of each cylinder 12. A torque support for the rotary distributor 22 is designated 48 in FIG. 1.

A further line 41 passing along the bore rods or formed thereby respectively and continuing on the drive shaft 10 leads with branchings to the filling spaces of cylinders 7 used for displacing movable tools 4.

A third line 42 disposed on the bore rods or formed thereby opens on the one hand into a further annular duct 43 of the rotary distributor 22, which is connected to the annular spaces of the cylinders 12 of the clamping device 11 by way of lines 44, 45, and continues on the other hand in a line 47 which passes along the drive shaft 10 and which branches and is connected to the annular spaces of the cylinders 7. A control line 46 branches off in each case from the lines 44 and 45 to the non-return valves 26 in order to block the latter. By supplying pressure medium to the line 42 the clamping elements 15 and the tools 4 may be moved inwards simultaneously.

The lines 21, 41 and 42 are connected at the surface to a control device, by means of which pressure medium may be selectively supplied from a source to each line or removed therefrom.

Figure 2:
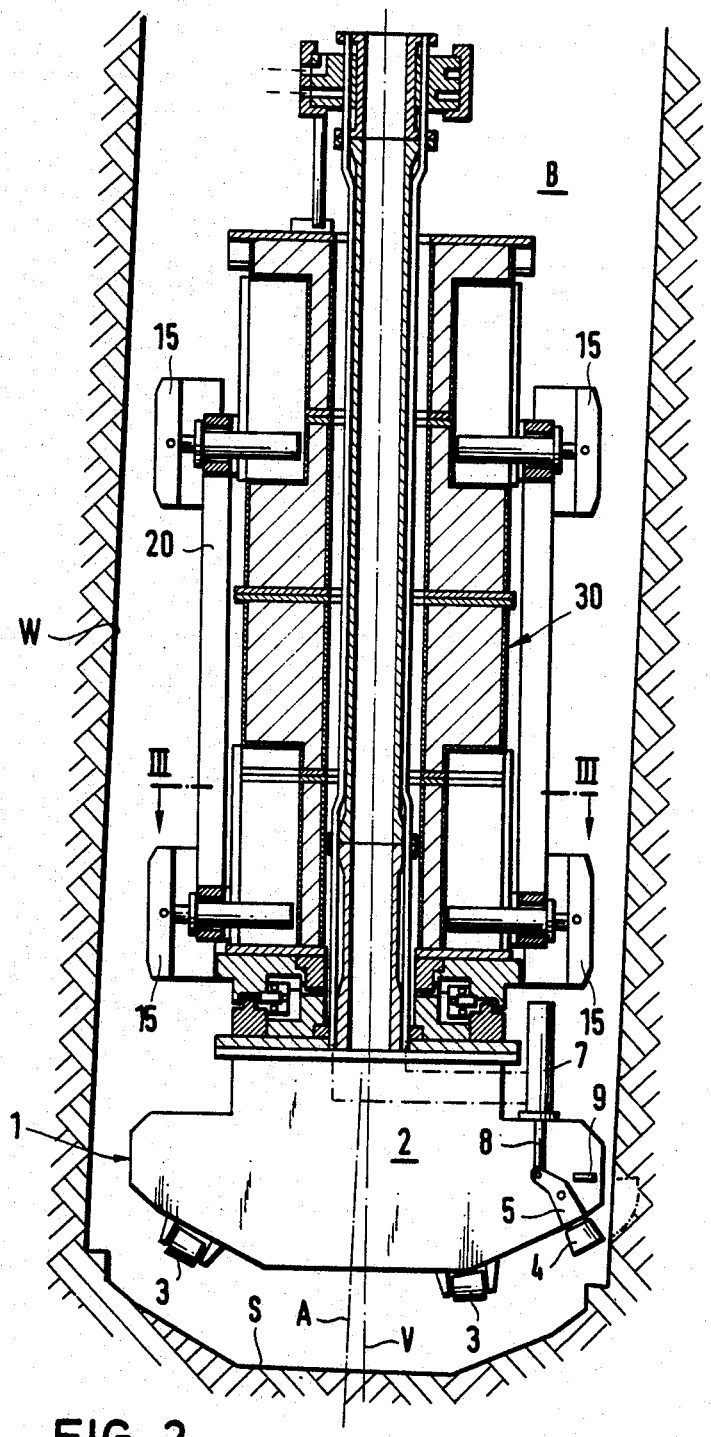
FIG. 2 is a view similar to FIG. 1 showing in a freely suspended position.

In FIG. 1 the borehole B is indicated vertically. If a deviation from the vertical V occurs after boring a section, as shown in FIG. 2 by the direction of the borehole walls W and a dash-dot line A, then the procedure according to the method of the invention is followed using an apparatus of the type described.

The clamping elements 15 of the clamping device 11 are moved in by pressure medium supplied by way of the lines 42, 44 and 45, the non-return valves being unlocked by the lines 46, and the bore head 1 is raised by a small amount from the bottom S of the borehole B by means of the bore rods. In addition, the tool 4 projecting the furthest radially or a plurality of such tools 4 is or are swung back from the outer position to the inside so that the state according to FIG. 2 is produced. The bore head 1 then hangs on the bore rods in a completely free and unobstructed manner and may be set exactly vertically under the influence of gravity as it has no supporting abutment on the borehole wall W. The clamping elements 15 are then moved out again by means of the piston-cylinder units by supplying pressure medium by way of the line 21, so that they bear against the borehole wall W as shown in FIG. 5. In this procedure the pistons 13 in the cylinders 12 and thus the clamping elements 15 can cover different distances as required by the different distances with respect to the borehole wall W extending inclined after the apparatus has moved into the vertical position. In addition the clamping elements 15 on the piston rods 14 may be adjusted accordingly in their angle on account of their articulated mounting. As a result of the released lines 42, 44, 45 and 46 the non-return valves are in the blocking position.

After this it is possible to begin to lower the bore head 1 and to begin a further bore section, the bore head 1 being rotated again by means of the rods and the drive shaft 10 as an extension thereof and the movable tool or tools 4 respectively being swung outwards again by means of the associated actuating device 7 by supplying pressure medium by way of the line 41. As a result of the trouble-free guidance during the preceding vertical adjustment, this new bore section is now bored in the vertical direction.

If, in the case of wide deviation from the vertical, the bore head 1 does not hang completely free even with the tools 4 swung in, but still bears against the borehole wall on one side, a substantial correction of the bore direction towards the vertical nevertheless takes place at the next bore section. The verticality is then attained at the following bore section for example.

In the manner of performing the method described above in connection with FIGS. 1 to 5 the individual bore sections are bored with the increased diameter of the bore head 1. Its diameter is only reduced in each case in order to determine the further direction of the bore in a position suspended on the bore rods (FIG. 2).

It is also possible, however, to bore successive bore sections with a relatively smaller diameter and to make an enlargement in which the bore head can occupy its position suspended on the bore rods only in order to determine a new bore direction. This is illustrated in FIG. 7 which shows the state reached during such a procedure before beginning to bore the next bore section in a newly determined bore direction, i.e. a state as illustrated in FIG. 5 for the procedure described above.

Figure 7:
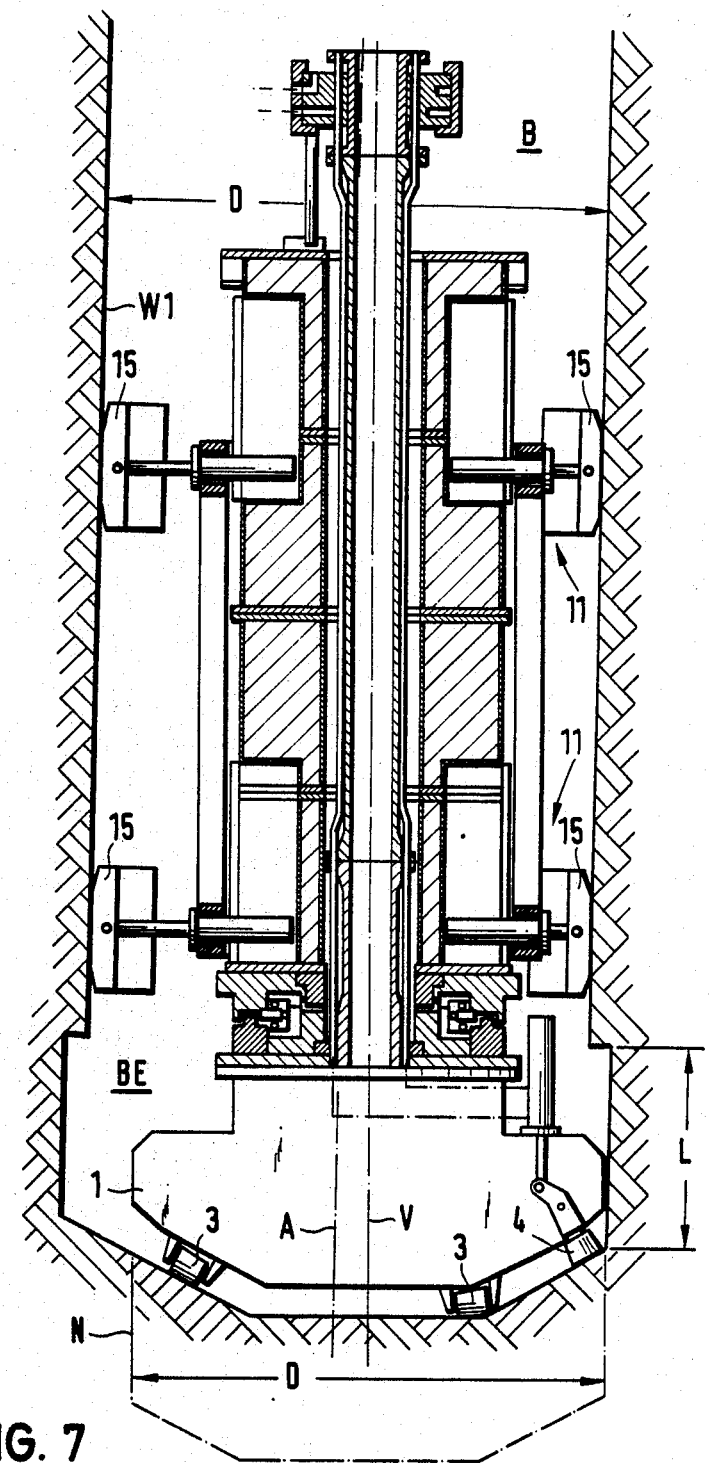
FIGS. 7 and 8 are views similar to FIG. 1 showing the apparatus in another embodiment of the method.
Figure 8:
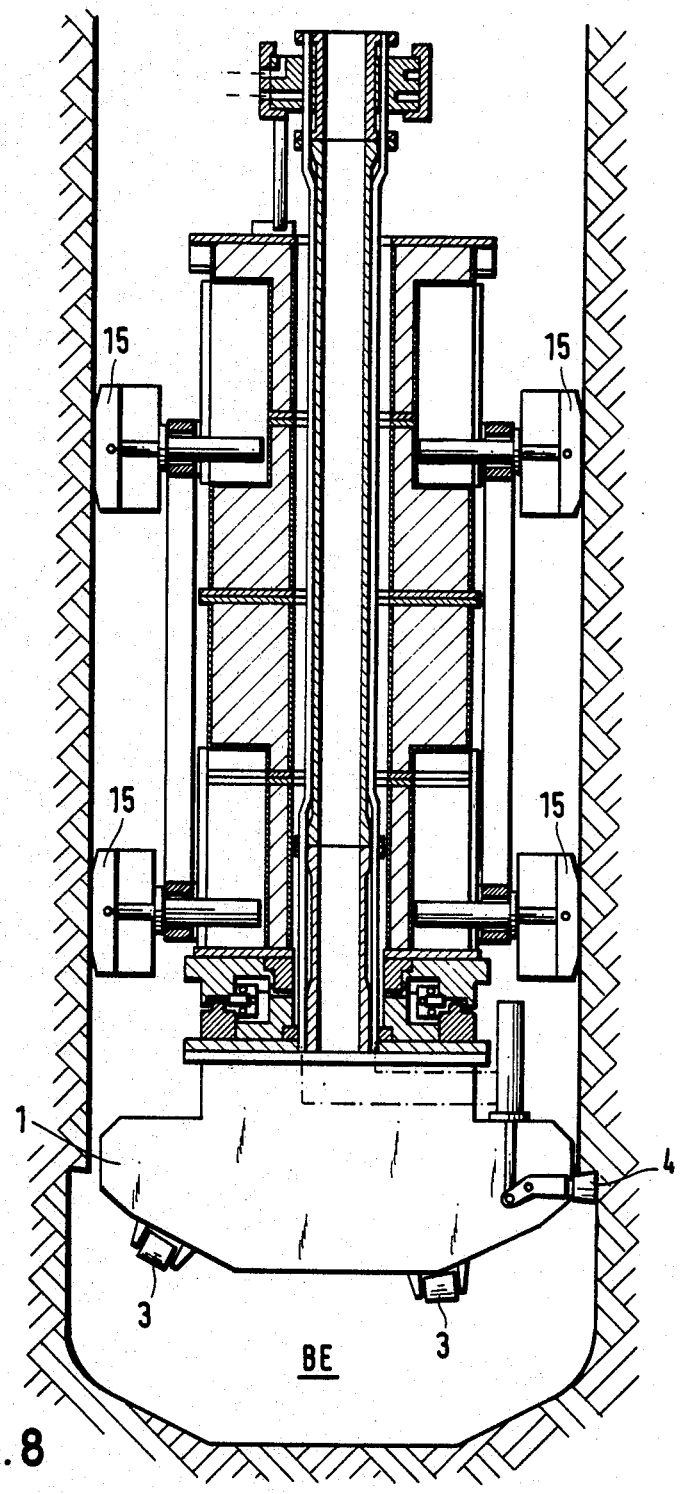

The preceding bore section with the walling W1 has been bored with the smaller diameter of the bore head 1, i.e. with the tools 4 swung in, as is also the case in the state for further boring according to FIG. 7. The letter D designates the diameter of the borehole B bored or to be bored in such a state of the bore head 1. It may be assumed that there is a deviation A from the vertical V, which is corrected. By swinging out the tool or tools 4 the operating diameter of the bore head 1 is increased and then a length L is bored which produces an enlarged borehole section BE. This enlargement BE may be bored inside the preceding bore section using the stroke of the bore head 1 relative to the clamping device 11, as the tools 4 are swung out in the course of this bore section. It is also possible, however, after finishing a normal bore section with the smaller diameter, to produce the enlargement BE by boring upwards by the necessary amount with the tools 4 extended. This is illustrated in FIG. 8.

When the tools 4 are retracted, i.e. when the diameter of the bore head 1 is reduced, after the clamping elements 15 are released the bore head 1 is moved by means of the bore rods to a level at which it is in the area of the enlargement BE and hangs freely on the bore rods. It then normally has sufficient space to occupy a vertical position. The new guidance direction provided thereby is then fixed by pushing out the clamping elements 15 and pressing them against the borehole wall. The next bore section can then be bored. This is indicated with the dash-dot line N in FIG. 7.

Figures 9, 10:
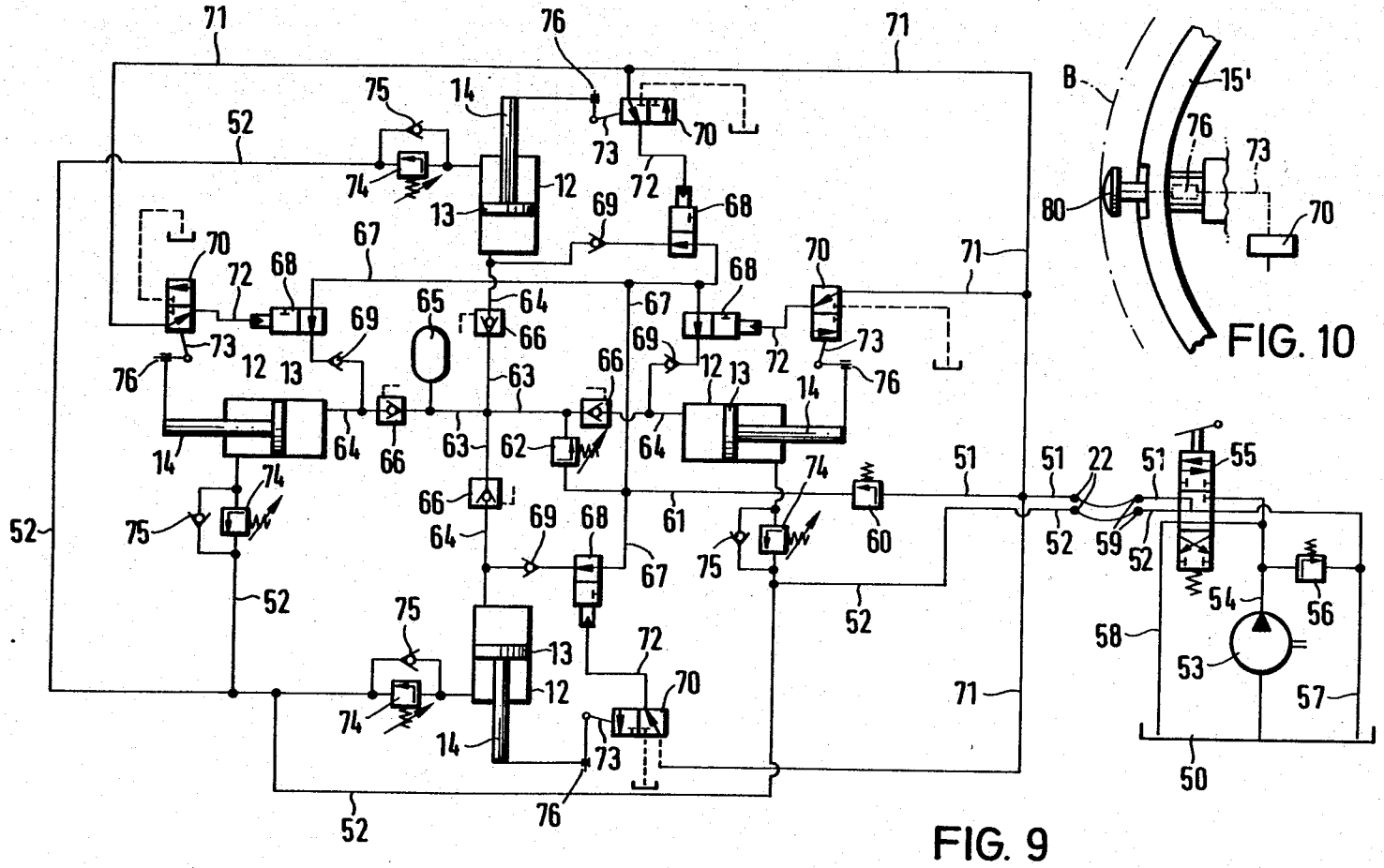
FIG. 9 is a schematic view of a further embodiment of a pressure medium system.
FIG. 10 is a partly schematic detail view of a clamping element.

A modified embodiment of an hydraulic system for supplying the cylinders 12 of the clamping device 11 is shown in FIG. 9, only four cylinders lying in one plane being illustrated. The diagram with the accompanying explanation applies accordingly to the cylinders in the second plane. The cylinders and their parts have been given the same numerals as in FIGS. 1 to 6.

A device situated on the surface contains a pump 53 which sucks pressure medium, e.g. water, from a tank 50 and the supply line 54 which leads to a directional control valve 55 which may be moved manually for example into the three switching positions shown. The desired maximum pressure may be set on a valve 56 forming a safety valve at the same time for the pump. The numerals 57 and 58 designate discharge lines leading to the tank 50. Two lines 51 and 52 pass from the directional control valve 55 and are connected—by a rotor, a rotary distributor 59 or the like provided at the upper end of the bore rods—to lines which extend on or in the bore rods and which continue by way of a rotor, a rotary distributor 22 or the like. All parts of the said lines have hitherto been provided with the same numerals.

The line 51 leads to a pressurizing valve 60 which is set for example to 10 bar and from which it continues as line 61 to a further pressurizing valve 62 set for example to 15 bar. From here branching lines 63 lead to blocks 66 which are conected in each case to the filling spaces of the cylinders 12 by lines 64. The blocks 66 may be constructed and connected, for example, like the unlockable non-return valves 26 in the case of the embodiment according to FIG. 6 and they have the same function as the latter. The numeral 65 designates an hydraulic accumulator which may be loaded to 70 bar for example and which is connected to the lines 63. The said hydrostore may compensate leakages and ensures that the clamping elements are always held firmly pressed against the borehole wall while maintaining the elevated clamping pressure.

In addition, control valves 68 are conected to the line 61 by way of line 67 and are further connected to the lines 64 by way of non-return valves 69. Lines 71 lead from the line 51 to on-off valves 70, from which pass lines 72 for actuating the control valves 68 by means of servo valves arranged upstream thereof. The on-off valves 70 may be actuated as a function of the paths covered by the piston rods 14 or the clamping elements 15 respectively or as a function of specific positions of the said parts reached by suitable elements, inter alia by limit switches or the like. A particularly advantageous embodiment lies in providing each clamping element 15' (FIG. 10) with at least one sensing element 80 which projects slightly beyond the clamping element 15', is held under the action of one or more springs for example in this front position determined by a stop and is guided movably relative to the clamping element 15'. Each sensing element 80 is connected to an associated on-off valve 70 by suitable transmission elements 73 in such a way that the on-off valve 70 is transferred from the position shown as operative in FIG. 9 into the second position when the sensing element 80 comes into contact with the borehole wall B as the clamping element 15' is moved outwards and is thus retracted in the direction of the clamping element. A member designated 76, which is influenced by a sensing element 80 or the like and which operates in the manner of a limit switch and causes the valve 70 to be switched over by way of the transmission elements 73, is shown diagrammatically in FIGS. 9 and 10.

The line 52 branches and leads to the annnular spaces in the cylinders 12. A counterpressure valve 74, for example a spring-loaded non-return valve, and parallel thereto a simple non-return valve 75 with a reverse flow direction are provided in the path of each line. The counterpressure valves 74 are set to a pressure which is favorable with respect to the outward movement of the pistons 13 where the pressure medium is forced out of the annular chambers of the cylinders 12.

If the directional control valve 55 is moved into a position in which the pressure medium supplied by the pump 53 flows into the line 51 and pressure medium can flow out of the line 52 by way of the line 57 to the tank 50, the pistons 13 in the cylinders 12 are pushed out and thus the clamping elements held by the piston rods 14 and not shown in FIG. 9 are moved outwards. The pressure medium flows by way of the pressurizing valve 60, the line 61, the lines 67, the control valves 68 and the non-return valves 69 to the filling spaces of the cylinders 12. This procedure lasts until the sensing elements 80 come to rest against the borehole wall and the on-off valves 70 are thereby actuated, so that they occupy their second position. The lines 72 thus lose pressure, so that the control valves 68 are transferred to their blocking position. In this way the pressure in the line 61 rises, so that the pressure medium now reaches the filling spaces of the cylinders 12 through the pressurizing valve 62, the lines 63, the blocks 66 and the lines 64. The pistons 13, which have already pushed the clamping elements to just in front of the borehole wall during the previous procedure, are thus now loaded at the same time with elevated pressure. In this way the clamping elements are pressed firmly against the borehole wall. When the clamping elements are moved out the medium forced out of the annular spaces of the cylinders 12 is led off to the tank by way of the counterpressure valves 74, the lines 51, the directional control valve 55 and the line 57.

If the clamping elements are released from the borehole wall and moved inwards, the directional control valve 55 will be brought into another position in which pressure medium supplied by the pump 53 now reaches into the line 52, while the line 51 together with the lines connected thereto is now opened towards the tank 50 by way of the line 57. The pressure medium flows from the lines 52 by way of the opening non-return valves 75 to the annular spaces of the cylinder 12 and forces back their pistons 13. The medium forced out of the filling spaces of the cylinders 12 flows back to the tank by way of the blocks 66, which are now opened like the blocks 26 according to FIG. 6, and also by way of the lines 63, 61, 51 and 57. The pressurizing valves 60 and 62 connect or combine with reversing valves, in particular automatic ones, (not shown) in such a way as to allow the medium to flow back.

We claim:

1. A method of sinking a substantially vertical borehole utilizing a rotatable variable diameter bore head suspended from and rotatably driven by a borehole drilling device including a set of bore rods and clamping elements engageable with the wall of the borehole, comprising:

determining the desired direction of the borehole;
clamping said device in the borehole;
setting the diameter of the bore head to a first diameter;
boring a section of the borehole by rotatably driving and moving the bore head;
discontinuing said boring step;
reducing the diameter of the bore head;
releasing said clamping;
moving the bore head in a stationary state into a position wherein it is substantially freely suspended in the borehole determining the direction of the next section of the borehole;
clamping said device in the borehole while maintaining substantially the position of the bore head relative to the borehole when in said suspended state;
resetting the bore head to a desired second diameter for boring the next section of the borehole; and
boring the next section of the borehole by rotatably driving and moving the bore head.

2. The method as claimed in claim 1 wherein said resetting step comprises increasing the diameter of the bore head to substantially said first diameter to produce successive borehole sections having substantially the same diameter.

3. A method of sinking a substantially vertical borehole utilizing a rotatable variable diameter bore head suspended from and rotatably driven by a borehole drilling device including a set of bore rods and clamping elements engageable with the wall of the borehole, comprising:

determining the desired direction of the borehole;
clamping said device in the borehole;
setting the diameter of the bore head to a first relatively smaller diameter;
boring a section of the borehole by rotatably driving and moving the bore head;
increasing the diameter of the bore head to a relatively larger diameter;
boring a section of the borehole to said relatively larger diameter for a predetermined length;
discontinuing said boring step;
reducing the diameter of the bore head to substantially said relatively smaller diameter;
releasing said clamping;
moving the bore head in a stationary state into a position wherein it is substantially freely suspended in the borehole determining the direction of the next section of the borehole;
clamping said device in the borehole while maintaining substantially the position of the bore head relative to the borehole when in said suspended state; and
boring the next section of the borehole to substantially said relatively smaller diameter.

4. A method as claimed in claim 3 wherein said predetermined length of boring at said relatively larger diameter is approximately equal to the height of the bore head.

* * * * *